US008986000B2

(12) United States Patent
Kraus et al.

(10) Patent No.: US 8,986,000 B2
(45) Date of Patent: Mar. 24, 2015

(54) FLARE PILOT DETECTION AND IGNITION SYSTEM

(75) Inventors: Kurt Kraus, Tulsa, OK (US); Dusty Richmond, Cleveland, OK (US); Jay Jennings, Tulsa, OK (US); Stefano Bietto, Tulsa, OK (US)

(73) Assignee: Honeywell International, Inc., Morristown, NJ (US)

( * ) Notice: Subject to any disclaimer, the term of this patent is extended or adjusted under 35 U.S.C. 154(b) by 487 days.

(21) Appl. No.: 13/352,830

(22) Filed: Jan. 18, 2012

(65) Prior Publication Data

US 2013/0022932 A1 Jan. 24, 2013

Related U.S. Application Data

(63) Continuation-in-part of application No. 12/905,309, filed on Oct. 15, 2010.

(51) Int. Cl.
*F23N 5/12* (2006.01)
*F23D 14/72* (2006.01)

(52) U.S. Cl.
CPC ..... *F23D 14/725* (2013.01); *F23N 5/123* (2013.01)
USPC ..... 431/74; 431/6; 431/75

(58) Field of Classification Search
USPC ..... 431/74, 6, 75, 24, 13, 77, 78, 79, 80
See application file for complete search history.

(56) References Cited

U.S. PATENT DOCUMENTS

| | | | | |
|---|---|---|---|---|
| 3,043,545 | A | 7/1962 | Lindberg, Jr. | |
| 4,245,977 | A | 1/1981 | Morese | |
| 4,470,799 | A | 9/1984 | Riggs | |
| 4,519,771 | A | 5/1985 | Six et al. | |
| 4,598,333 | A | 7/1986 | Adams et al. | |
| 4,599,568 | A | 7/1986 | Couch | |
| 6,089,856 | A * | 7/2000 | Wolcott et al. | 431/18 |

FOREIGN PATENT DOCUMENTS

| | | | |
|---|---|---|---|
| JP | 62142922 | A | 6/1987 |
| JP | 0745932 | B2 | 5/1995 |
| JP | 3408887 | B2 | 3/2003 |

OTHER PUBLICATIONS

International Search Report and Written Opinion for PCT/US2013/020732, mailing date May 15, 2013, Applicant's file reference H0027403-1.

* cited by examiner

*Primary Examiner* — Alfred Basichas

(57) ABSTRACT

A system having a flame rod assembly for operation in a high temperature pilot burner. The assembly is designed for operation in temperatures from about −40 to 1100 degrees C. The system may operate in inclement weather involving high speed winds and significant amounts of moisture and rain to hurricane storm force levels and rates. The system incorporates an electrical apparatus which may provide flame sensing and ignition via the flame rod assembly incorporating a quick drying insulator around a rod of the assembly to ensure proper operation of the electrical apparatus.

20 Claims, 4 Drawing Sheets

FLARE PILOT DETECTION AND IGNITION SYSTEM

The present application is a continuation-in-part of U.S. patent application Ser. No. 12/905,309, filed Oct. 15, 2010, and entitled "A Rapidly Self-Drying Rectifying Flame Rod". U.S. patent application Ser. No. 12/905,309, filed Oct. 15, 2010, is hereby incorporated by reference.

BACKGROUND

The present disclosure pertains to flame sensing and ignition and particularly to precipitation resistant mechanisms for sensing and igniting pilots.

SUMMARY

The disclosure reveals a system having a flame rod assembly for operation in a high temperature pilot burner. The assembly is designed for operation in temperatures from about −40 to 1100 degrees C. The system may operate in inclement weather involving high speed winds and significant amounts of moisture and rain. The system incorporates an electrical apparatus which may provide flame sensing and ignition via the flame rod assembly incorporating a quick drying insulator around the rod.

DESCRIPTION

Figure 1:
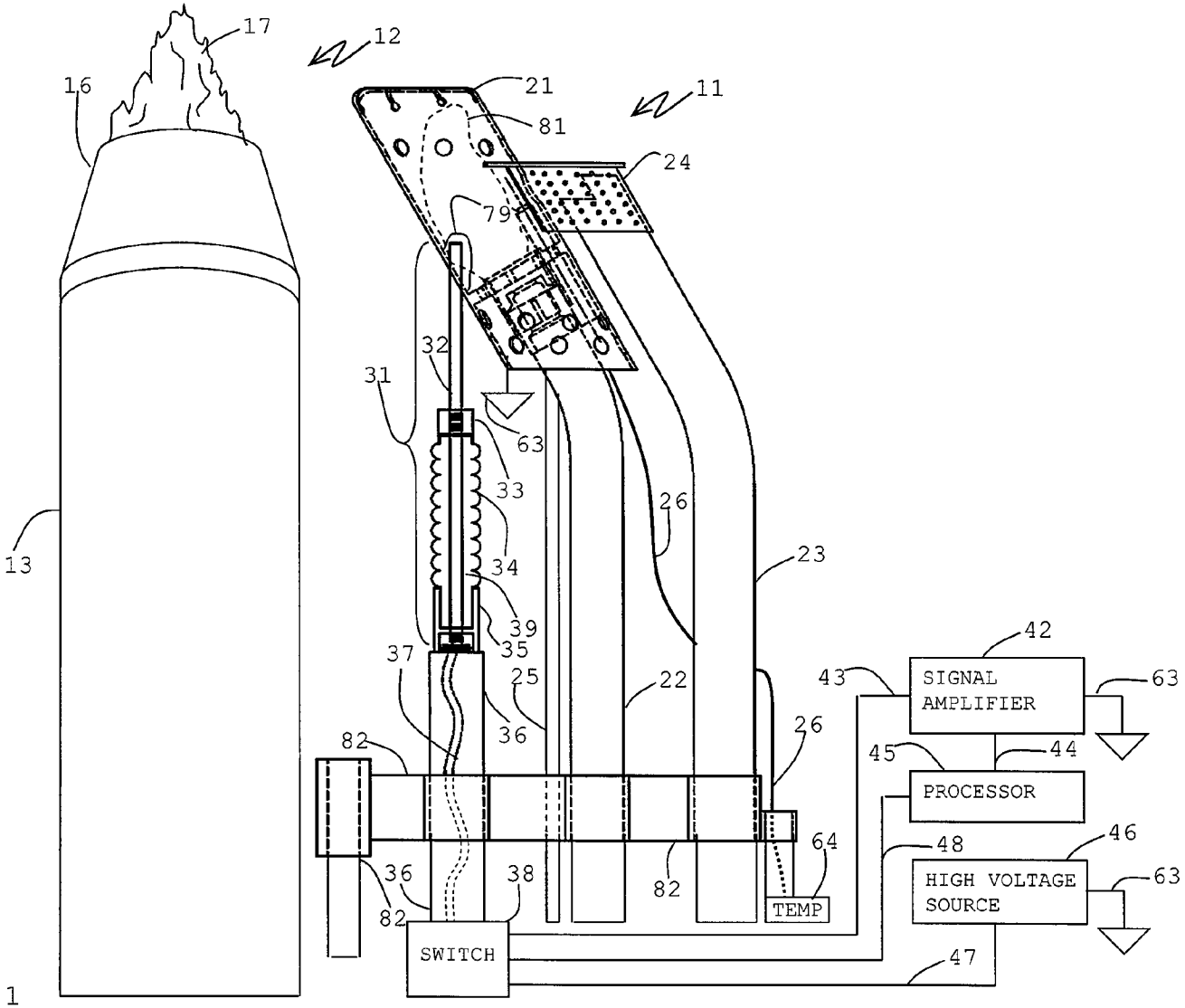
FIG. 1 is a diagram of a pilot for an industrial process flare assembly.

An industrial process flare may need a computerized electronic management system to continuously monitor the existence of its pilot flame. This may be to ensure that the flare will ignite when the need arises. As electronic management technology advances, a closed loop feedback time cycle required may decrease. However, related art flame monitoring technology is currently not necessarily providing adequate response times.

Ionization flame rod technology may indicate an existence of a flame virtually instantaneously. Because of extreme environmental conditions, a product is needed for use in flare pilot applications. The product may utilize several characteristics to overcome various challenges. A location of the flame rod may ensure that it will work continuously in high wind speed environments. A hermetic seal and a particular profile of a rod insulator may keep heavy rain and moisture from causing a failure of the flame rod. A signal cable connected to the rod at the insulator should be of the type that can withstand high temperatures. The materials and manufacturing processes may allow the resultant flame rod product to withstand very high temperatures during an operational life. Also, such product may be rapidly self-drying. These considerations may differentiate the present flame rod product from other flame rod technology in terms of reliability and service life, thus giving a holder of the present flare rod product a competitive advantage in the flare and flare pilot market.

The present product may contain a limited number of parts. The flame rod and its threaded connections may be either cast or machined from a steel or stainless steel alloy (selected as required for service). The insulator may be made of any suitable insulating material, such as ceramic. The insulator material may be cast with a specific geometry and attached to a flame rod at the end connections via a high temperature coupling with brazing or welding. "Brazing" or "welding" may be referred to as "brazing" herein. "High temperature" brazing may withstand temperatures at least up to 1100 degrees Celsius (C.) (2012 degrees F.). The brazing process may satisfy specifications for integrity and temperature requirements. Results of high temperature brazing may withstand temperatures equal to or greater than about 815 degrees C. (1500 degrees F.). The high temperature brazing process may involve a use of alloys incorporating materials such as chromium, nickel, and other like materials. Ordinary or low temperature brazing may involve a use of materials such as copper, silver, and the like.

A signal cable attached to the flame rod may have a high temperature rating sufficient for the operating conditions. An example flame rod product may meet geometrical requirements as revealed in FIG. 2. The metallic materials may be machined or cast from suitable steel or stainless steel alloys. The alloys may incorporate, but are not necessarily limited to, ASTM 304, ASTM 310, ASTM 316, Inconel™, Kanthol (or Kanthal), hastaloy (or Hastelloy™), and so forth.

An ignition/flame rod for a flare may provide flame ignition through sparking and detection through ionization detection in a pilot for a flare system. The product may be exposed to extreme temperatures (i.e., −40 to 1100 degrees C.). The product may be mounted several hundred of feet above the ground in the air, or mounted close to the ground, or somewhere in between. The product needs to withstand the extreme temperatures without having its performance affected. The product should be robust enough to have at least five years of life without issues, which may be the typical lifecycle of a refinery between service times. Detection should be reliable at a six-sigma level and be without false positives.

In sum, certain aspects of the present product may incorporate self drying capabilities, a temperature resistance up to 1100 Celsius degrees, and a combination of detection and ignition capabilities. Particularly, the ceramic insulator may have self-drying capabilities. Likewise, the flame rod may have self-drying capabilities.

Figure 4:
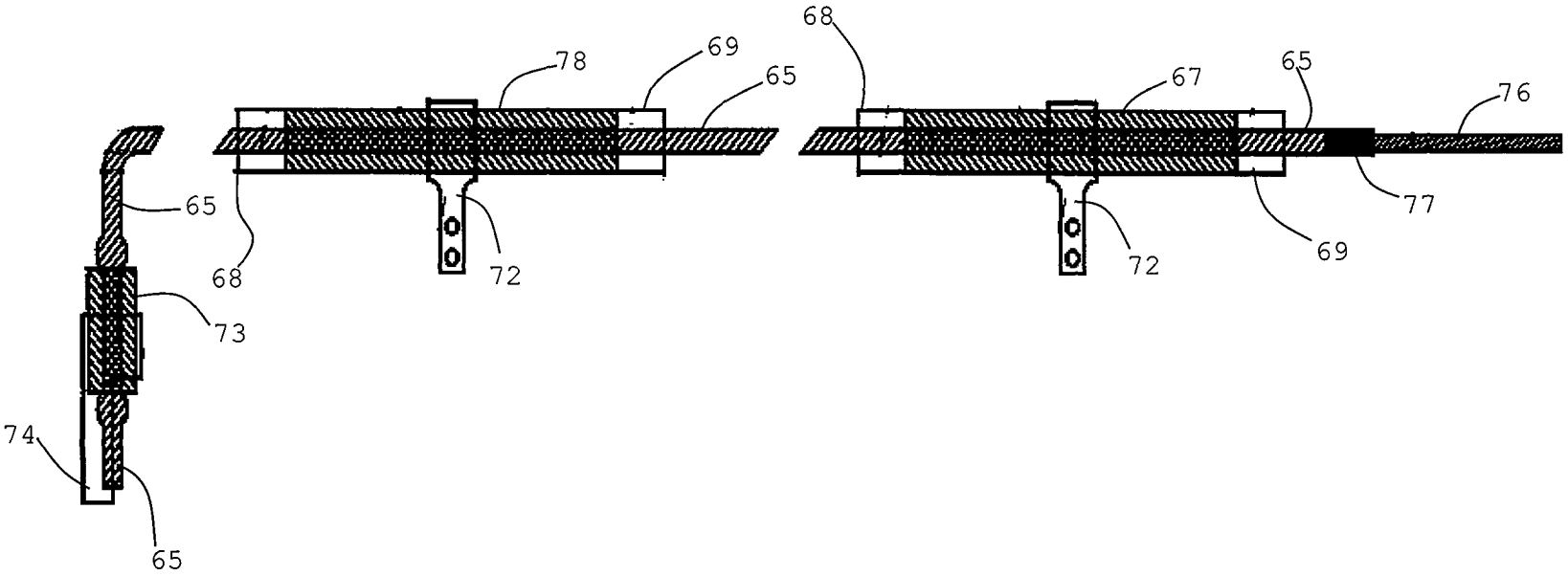
FIG. 4 is a diagram of still another configuration of a flame rod assembly.

The flame rod may be made of a high temperature, high performance (HP) alloy, to withstand the severe temperatures produced both by the pilot flame and by the flare flame. The rod may be connected to a longer rod or tubing made of a high temperature resistant alloy. An electrical signal may be transmitted through a naked rod/tubing to a wire several feet below and then to an electric box. The electric box may provide a carrier voltage for ionized gas detection from the pilot flame through a flame relay and another voltage for sparking through a high voltage transformer. A switch may allow an electrical passage selectively between the two devices. The switch box may be placed at a ground level. Two ceramic insulators may provide protection against short circuiting and may be placed in the upper part of the unit, where the naked rod is the distance between the two ceramic assemblies (FIG. 4). The distance may, for example, be several feet. The tip of the rod may be inserted in the pilot tip above the gas spud.

A ceramic insulator assembly may be provided. A flame rod may be purchased and inserted in the ceramic insulator. High temperature alloy tubing or a rod may be attached to the bottom end of the insulator assembly with a coupling. The second ceramic insulator assembly may be inserted in the high temperature alloy tubing or rod. A wire may be attached to the bottom part of the assembly and run all the way to the switch box. The switch box may be placed at grade, or where the customer specifies, and it may be connected to the electric power source.

FIG. 1 is a diagram of a pilot 11 for an industrial process flare assembly 12. Flare 12 may have a tube or stack 13. On top of tube 13 may be a nozzle 16 upon which a flare main flame 17 of flare 12 can arise and burn. In examples of application, a gas flare or flare stack may be used to eliminate fluids such as combustible waste, process gas or other material at oil wells, gas wells, rigs, refineries, chemical plants, refinery process units, chemical process units and so on. A present concern is to continuously monitor the existence of the flame of the pilot 11 for flare 12. Flare 12 might not necessarily always have a flame 17 if there is no fluid or material to burn; however, flare 12 should be ready to burn with a flame 17 at virtually any time. Such readiness may require a pilot 11 proximate to flare 12.

The present approach and apparatus may be used for assuring that a flame from pilot 11 is present for flare 12. Pilot 11 may incorporate a pilot burner 21 which provides the flame which is present for flare 12 in case the flare needs to be ignited to obtain a flame 17 to burn off gas or whatever is provided via tube or stack 13. A tube 22 may provide an air and fuel mixture for sustaining the flame of the burner 21 of pilot 11. A tube 23 with screen and/or deflector 24 may provide a flame front generator (FFG) for igniting the pilot burner 21 in situations where the flame of the pilot burner 21 has ceased. A tube 25 may be connected to tube 22. Tube 25 may provide high energy (capacitance discharge) ignition up stream of the fuel air mixture delivery to burner 21 from tube 22. Tubes 23 and 25 may provide alternate forms of ignition for the pilot burner 21. In burner 21, there may be a thermocouple and line 26 which may determine whether or not burner 21 is operating with a measurement of temperature at the burner. Thermocouple and line 26 may be connected to a temperature indicator 64. A concern may be a slow indication of temperature change at burner 21. The slow indication may imply that if the pilot flame at burner 21 goes out, there may be a delay for the burner 21 assembly to cool down sufficiently to reveal an absence of the pilot 11 flame, and then for an ignition of the pilot flame to occur. Heat from the pilot main flame 17 may inadvertently heat the thermocouple 26 when the pilot flame is extinguished causing a false positive indication of the presence of flame at the pilot burner 21.

A high temperature cable 37 may be attached to the end of a rod 39 with a crimp connection, screw connection, braze or weld. Cable 37 may be to go through pipe or conduit 36 to an electrical switch mechanism 38.

Rod 32 may be regarded as a multi-mode device. In one mode, rod 32 may be a part of an ionization device for detecting whether the pilot burner 21 flame is on or not. The detecting may be nearly instantaneous. In another mode, rod 32 may be part of an ignition device for igniting the gas/air mixture to pilot burner 21 in an event that the flame in the pilot burner has been extinguished. An operating carrier voltage to rod 32 in an ionization or detection mode may, for instance, be in a range from 100 to 200 volts. The noted operating detection voltage range is an illustrative example but may be of other ranges. The operating voltage to rod 32 in an ignition mode may be in a range from 10 to 20 thousand volts. The noted operating ignition voltage range is an illustrative example but may be of other ranges. Switch mechanism 38 may provide a selected voltage to rod 32 via rod 39 and cable 37. Rods 32 and 39 in some approaches as may instead be a one-piece rod.

Insulator 34 may be for high voltage isolation (i.e., up to 20,000 volts) of rod 32 from various items in the environment. The rod 39 portion in insulator 34 may be hermetically sealed from the environment. Insulator 34 may have a corrugated shape or other advantageous shape on its external portion to prevent the various items, such as heavy rain, from causing electrical shorts or failures. Insulator 34 may be positioned relative to flame 17 and/or flame 21 so as to be dried almost instantly. Insulator 34 may be fabricated from other suitable insulating materials besides ceramic.

A structure 82 may hold and support tube 22, tube 23, tube 25, tube 36 and thermocouple line 26.

When a flame is emitted by pilot burner 21, the combustion process may create and move a field of ionized gas 81 as a part of the burner flame. An effect of an ionized gas field 81 in the flame may result in an electrical voltage or potential occurring between the metal burner 21 and flame rod 32, as rod 32 may be situated through an opening 79 of burner 21 to be in the ionized gas field 81. The voltage may be conveyed over a carrier signal emitted by a flame rod signal amplifier 42. The signal may be conveyed from rod 32 via coupling 33, rod 39, coupling 35, cable 37, switch 38 and line 43 to amplifier 42 for conditioning into a useful signal at an output 44. Amplifier 42 and burner 21 may be connected to a common ground 63.

Output 44 may indicate whether there is a flame in the pilot burner 21. If there is no flame, then output 44 via a processor 45 may cause electrical box 38 to send a very high voltage from voltage source 46 via line 47 to rod 32 in form of a spark to ignite the fuel/air mixture from tube 22 so as to re-light the pilot burner 21. Voltage source 46 and burner 21 may be connected to the common ground 63.

Switch 38, processor 45, signal amplifier 42 and high voltage source 48 may assembled together as illustrated or alternately constructed together into a single electrical device. Alternately, switch 38, processor 45, signal amplifier 42 and high voltage source 46 may be constructed in any combination of combined devices.

Figure 2:
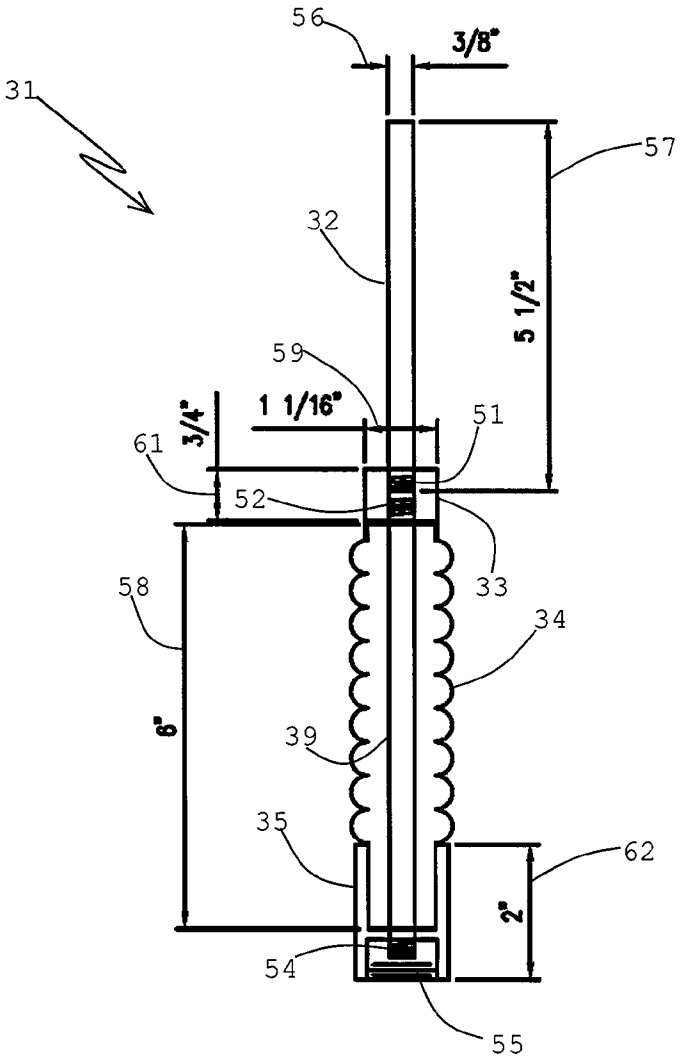
FIG. 2 is a diagram of an illustrative example of a flame rod assembly for a detection and ignition mechanism.

FIG. 2 is a diagram of a flame rod assembly 31 for the detection and ignition mechanism. The mechanism may quickly detect pilot 11 flame failure and provide a prompt ignition of the pilot 11 burner 21 flame. The flame rod may be two components 32 and 39. Rod 32 may be a flame rod portion which is of a cast and/or machined stainless steel alloy. Coupling 33 may connect rod 32 to an insulator 34. An end 51 of rod 32 and an end 52 of rod 39 may be threaded and be screwed into threaded counterparts in both ends of coupler 33. Coupler 33 may be of a cast and/or machined stainless steel alloy. Insulator 34 may be composed of ceramic or other similar appropriate material. Coupling 33 may be attached to insulator 34 with a compression, a brazed, high temperature sealed connection. At a base of insulator 34 may be a stainless steel coupling 35 brazed to the insulator. Coupling 35 may be attached with a weld, braze or threaded ends, to a conduit or pipe 36, as shown in FIG. 1. An end 54 of rod 39 and an upper portion of coupling 35 may be threaded for connection to each other. The lower portion of coupling 35 at end 55 may be threaded for connection to pipe or conduit 36 (FIG. 1). Even though the flame rod is shown to be two rods or pieces 32 and 39 connected together by being threaded into coupling 33, rods 32 and 39 may alternatively be a one piece rod. In either rod structural approach, rod or rod portion 32 may have a significant portion of its unconnected end situated in the pilot burner 21 via opening 79 (FIG. 1).

FIG. 2 further shows example dimensions of assembly 31. Dimension 56 of ⅜ inch may be a diameter of rod portions 32 and 39. Length 57 of rod portion 32 may be 5 and ½ inches. Length 58 of insulator 34 may be approximately 6 inches or more. Diameter dimension 59 of coupling 33 may be approximately 1 inch. A length dimension 61 of coupling 33 may be approximately ¾ inch. A length dimension 62 of coupling 35 may be 2 inches. These dimensions may instead be of other magnitude values.

Figure 3B:
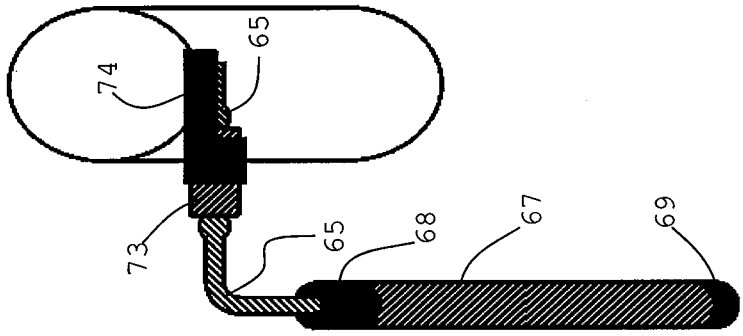
FIGS. 3*a* and 3*b* are diagrams of configurations of a flame rod assembly for a pilot burner.
Figure 3A:
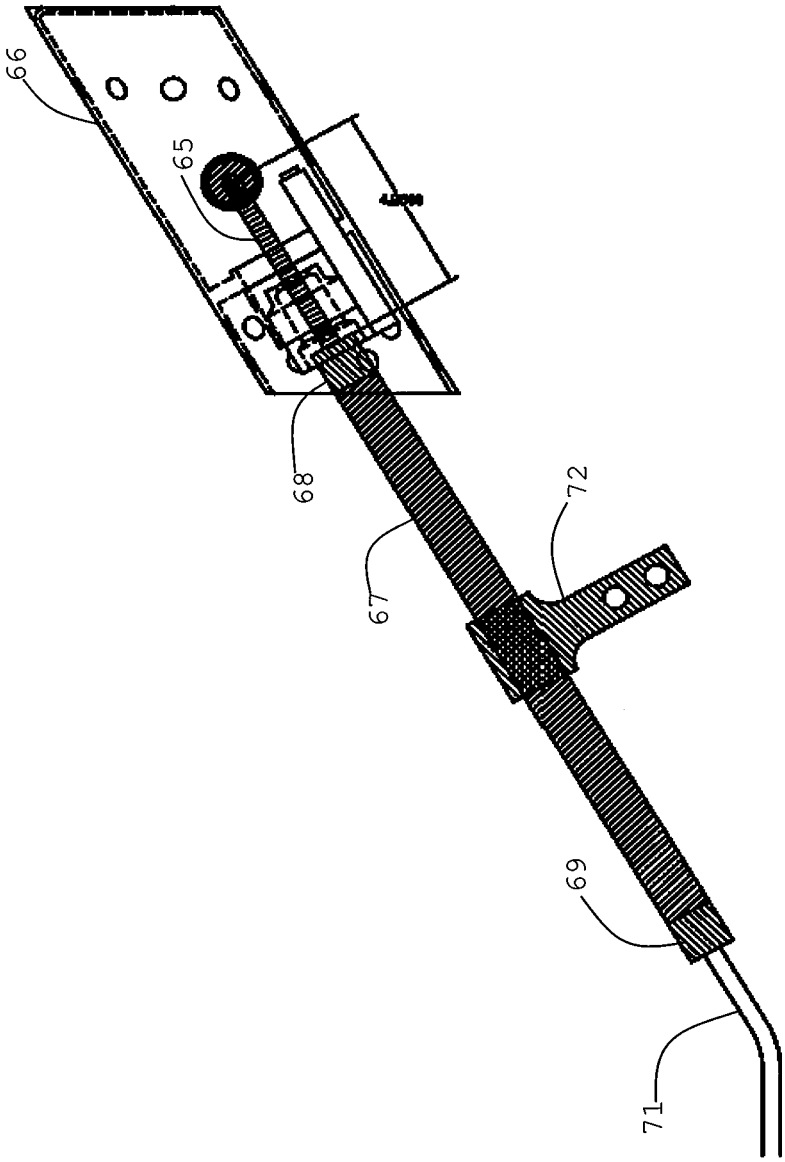

FIG. 3*a* is a diagram of a configuration of a stainless steel flame rod 65 assembly situated in a pilot burner 66. A ceramic insulator 67 may be situated on flame rod 65 with compression fittings 68 and 69 brazed to or compressed against and sealing to the ceramic at the ends of insulator 67. A high temperature cable 71 may be connected to rod 65 at fitting 69. A mounting bracket 72 may be secured around ceramic insulator 67.

FIG. 3*b* is a diagram of another configuration of a flame rod 65 assembly. Fittings 68 and 69 may be brazed to the ends of ceramic insulator 67 to secure it to rod 65. Rod 65 may be bent for another kind of a burner. Rod 65 may have an insulator 73 on a portion of the rod near the burner. A ring-like bracket 74 on insulator 73 may be welded or brazed to a pilot tip.

FIG. 4 is a diagram of still another configuration of a flame rod 65 assembly. There may be a conducting rod or cable 76 connected to flame rod 65 with a coupling 77. A ceramic insulator 67 may be around rod 65 and secured with compression fittings 68 and 69 brazed to the ceramic insulator 67. To the left of fitting 68 in the Figure, there may be a significant length of un-insulated rod 65 until another ceramic insulator 78 is provided on rod 65 beginning at another NPT compression fitting 69 brazed or otherwise sealed to insulator 78. At the other end of insulator 78 may be another fitting 68 brazed or otherwise sealed to the ceramic insulator 78. Mounting brackets 72 may be secured around insulators 67 and 78. Rod 65 may extend from insulator 78 and have a curve for a particular kind of burner. A ceramic insulator 73 may be formed on rod 65 close to the end of the rod. A ring-like bracket 74 formed on insulator 73 may be rested against, welded or brazed to a pilot tip.

With reference to FIGS. 1-4, insulators 34, 67 and 78 may become wet from exposure to environmental elements such as precipitation. Insulators 34, 67 and 78 may have a length, shape and design so as to minimize the possibility of electrical short circuiting from the flame detection/ignition rods 32, 39, 65, 71 and 76 to grounded supports 35 and 72. Insulators 34, 65 and 78 may also be positioned relative to the burner flame 21 and/or the main flare flame 17 such that radiant heat from either or both flame 21 and flame 17 will rapidly (nearly instantaneously) dry a wet insulator 34, 67 or 78 thereby eliminating a possible short circuit. A short circuit may otherwise render the ignition and flame detection capabilities of the present system inoperable.

The position the insulators 34, 67 and 78 from the flare 12 and burner 21 may vary relative to the size of the flare flame 17 and/or the burner 21 flame. However, if the flare flame 17 is extinguished, for instance in a case where there is no material available for burn-off, then the burner 21 flame needs to be sufficiently large or hot enough to keep the insulator dry at virtually all times even for a short period when the burner 21 flame may be accidentally or intentionally be extinguished for some reason. In case of such extinguishment, the insulator should be sufficiently hot enough to maintain a dry condition in a worse case environment of precipitation for a period of time long enough (e.g., thermal inertia) until burner 21 can be relit with a flame.

The length of the insulators 34, 67 and 78 should be sufficiently long enough and thick enough to prevent arcing between the rod and, for example a grounded component such as a support strap, during a conveyance of a high voltage via the rod during an igniting of burner 21. The needed length, thickness and/or diameter of the insulators may depend on the magnitude of the ignition voltage. Also, the dimensions (e.g., diameter, thickness and length) of the insulators should be sufficient so that leakage of ionization signals for indicating a presence or non-presence of a burner 21 flame is sufficiently small so that the signals are strong enough at the recipient end for detection. The material content of the insulator should also have a very small conductance factor. Ceramic may be an example of such insulator material.

The shape of insulators 34, 67 and 78 may aid in reduction of the effects of precipitation on the insulators. An example design may incorporate a corrugated external surface on the insulators. The shape of the insulators may be selected from a variety of designs. Further, the insulators may have straight and/or curved configurations. Other design factors of the insulators may be implemented.

In sum, the factors of insulators 34, 67 and 78 such as position relative to and distance from flare 12 and/or burner 21, insulator temperature, length, thickness, diameter, material content, shape, configuration and other factors may be interdependent (e.g., in terms of quantification) in that, for example, a strong factor may compensate for a weak factor. The design and layout of the flare 12 and burner 21 may indicate factors needed for effective insulators. The location and environment of the flare and burner may indicate considerations such as cold, humid, hot, dry, windy, calm and other conditions, which may dictate needed specifics for insulators.

In the present specification, some of the matter may be of a hypothetical or prophetic nature although stated in another manner or tense.

Although the present system and/or approach has been described with respect to at least one illustrative example, many variations and modifications will become apparent to those skilled in the art upon reading the specification. It is therefore the intention that the appended claims be interpreted as broadly as possible in view of the related art to include all such variations and modifications.

What is claimed is:

1. A method for detection and ignition, comprising:

providing a flame rod having a first end at a flame location of a burner;

covering a portion of the flame rod with an insulator at a predefined distance from the first end of the flame rod;

determining whether there is a flame at the burner by detecting a voltage, if any, on the flame rod caused by a field of ionization gas of a flame; and igniting the burner with a voltage spark from the flame rod to start a flame at the burner; and wherein the insulator eliminates effects of moisture to prevent an electrical malfunction of the flame rod which makes the flame rod inoperable relative to detecting a voltage on the flame rod caused by a field of ionization gas of a flame or relative to igniting the burner with a voltage spark.

2. The method of claim 1, wherein:

the insulator comprises a material tolerant of temperatures up to 1100 degrees C.; and the flame rod comprises a conductive material tolerant of temperatures up to 1100 degrees C.

3. The method of claim 1, wherein the insulator comprises a corrugated outside surface.

4. The method of claim 1, wherein:

the insulator is at a predetermined distance from the burner; and the insulator is virtually instantly self-drying when the burner has a flame.

5. The method of claim 2, further comprising:
attaching a coupling to the insulator with a high temperature braze or weld; and
attaching the flame rod to the coupling with a high temperature braze or weld; and
wherein a high temperature braze or weld endures temperatures up to 1100 degrees C.

6. The method of claim 1, wherein:
the insulator is at a predetermined distance from a flare stack; and
the insulator is virtually instantly self-drying when the flare stack has a flame.

7. A detection and ignition system comprising:
a flame rod;
an electrically insulating sleeve situated around a portion of the flame rod at a first end;
an electrical switch connected to the first end of the flame rod;
a signal amplifier for indicating an ionization field on the flame rod, the signal amplifier connected to the switch; and
an electrical spark source connected to the switch; and
wherein:
the switch comprises a first position and a second position;
the first position connects the amplifier to the flame rod;
the second position connects the electrical spark source to the flame rod; and
the insulating sleeve prevents precipitation from electrically affecting the flame rod.

8. The system of claim 7, wherein:
the flame rod has a second end situated at a pilot burner;
the flame rod can ignite the pilot burner with an electrical spark; and
the flame rod can detect a flame at the pilot burner from a field of ionized gas created by the flame which causes a voltage to appear on the flame rod.

9. The system of claim 7, wherein the electrically insulating sleeve comprises a corrugated external surface.

10. The system of claim 7, wherein:
the second end of the flame rod comprises a dual mode; and
the dual mode comprises a detection mode and an ignition mode.

11. The system of claim 10, wherein:
the amplifier is connected by the switch to the first end of the flame rod in the detection mode; and
the electrical spark source is connected by the switch to the first end of the flame rod in the ignition mode.

12. The system of claim 7, wherein the sleeve comprises a ceramic material.

13. The system of claim 7, wherein the flame rod comprises a steel alloy.

14. The system of claim 13, further comprising:
a cable connecting the switch to the first end of the flame rod; and
the cable is tolerant of temperatures up to 1100 degrees C.

15. The system of claim 14, wherein:
the connection of the cable at the first end of the flame rod is achieved with a high temperature braze or weld; and
a high temperature braze or weld endures temperatures up to 1100 degrees C.

16. A detection and ignition system for comprising:
a first elongated piece of metal;
an elongated insulator having a first end attached to a first end of the first elongated piece of metal; and
a second elongated piece of metal having a first end attached to a first end of the first elongated piece of metal and situated through a hole in the elongated insulator; and
wherein:
the first elongated piece of metal, the second elongated piece of metal and the elongated insulator are tolerant of temperatures up to 1100 degrees C.;
the first elongated piece of metal configured to convey a signal voltage indicating a flame in a pilot burner; and
the first elongated piece of metal configured to convey an ignition voltage for lighting a flame at the pilot burner; and
the elongated insulator is situated within a predetermined distance from the pilot burner having a flame for virtually instantaneous moisture removal from the elongated insulator.

17. The system of claim 16, wherein the insulator has an eternal surface which comprises indentations in the surface for a larger external surface than the external surface without the indentations.

18. The system of claim 16, further comprising:
a selector switch connected to a second end of the second elongated piece of metal;
an amplifier connected to the selector switch; and
a ignition voltage source connected to the selector switch; and
wherein the selector switch can connect the amplifier or the ignition voltage source to the second end of the second elongated piece of metal.

19. The system of claim 18, wherein the selector switch indicates a selection of a flame detection mode or a flame ignition mode.

20. The system of claim 19, wherein:
the amplifier amplifies a voltage created on the first elongated piece of metal by a field of ionization gas from a flame of the pilot burner;
the ignition voltage source provides a spark for igniting a flame at the pilot burner; and
a second end of the first elongated piece of metal is proximate to the pilot burner sufficient for igniting a flame at the pilot burner and for detecting the voltage created by the field of ionization gas from the flame at the pilot burner.

* * * * *